United States Patent [19]

Wilmes

[11] 4,185,416

[45] Jan. 29, 1980

[54] WEATHERSTRIP

[75] Inventor: Richard J. Wilmes, Stillwater, Minn.

[73] Assignee: Andersen Corporation, Bayport, Minn.

[21] Appl. No.: 926,274

[22] Filed: Jul. 20, 1978

[51] Int. Cl.[2] ..... E06B 7/24

[52] U.S. Cl. ..... 49/406; 49/483; 49/485; 49/495

[58] Field of Search ..... 49/406, 458, 483–498

[56] References Cited

U.S. PATENT DOCUMENTS

| | | | |
|---|---|---|---|
| 1,763,603 | 6/1930 | Donahue | 49/495 X |
| 2,234,533 | 3/1941 | Nolan | 49/485 X |
| 2,400,470 | 5/1946 | Spraragen | 49/485 X |
| 2,513,789 | 7/1950 | Dudley | 49/485 |
| 2,593,305 | 4/1952 | Hunter | 49/485 X |
| 3,108,852 | 10/1963 | Olsen | 49/485 X |
| 3,385,001 | 5/1968 | Bordner | 49/498 X |
| 3,432,966 | 3/1969 | Bordner | 49/483 X |
| 3,518,792 | 7/1970 | Williamson et al. | 49/495 X |
| 3,656,260 | 4/1972 | Weaver et al. | 49/498 X |
| 4,112,623 | 9/1978 | McPherson | 49/406 X |

OTHER PUBLICATIONS

Page 42 Andersen Detail Catalog No. 782.
Marvin Patio Door Advertisement.

*Primary Examiner*—Philip C. Kannan
*Attorney, Agent, or Firm*—Merchant, Gould, Smith, Edell, Welter & Schmidt

[57] ABSTRACT

An improved weatherstrip for sealing the meeting stiles of a sliding door unit. The weatherstrip material comprises two, longitudinally elongated weatherstrip members. Each weatherstrip member has a substantially rigid base section which is fixedly secured to the stile. A first flexible leg extends out from the base section at an angle relatively thereto to resiliently engage corresponding legs on the opposed weatherstrip member. A second resilient leg may also be provided for sealing against the sides of the meeting stile.

10 Claims, 6 Drawing Figures

WEATHERSTRIP

BACKGROUND OF THE INVENTION

1. Field of the Invention

This invention relates generally to an improved weatherstrip system and material to prevent rain, snow, and air infiltration between the sides of a door or window and the frame or casing in which the door or window is mounted. More particularly, this invention relates to an improved weatherstrip for use between the door panels in a sliding glass door unit.

2. Description of the Prior Art

Most buildings constructed today have a significant number of movable or openable windows, doors, or similar portals into the interior of the building. Although such doors and windows are necessary from both a practical and aesthetic point of view, they allow weather elements from the outside to infiltrate into the building. In particular, they allow air infiltration into the interior of the building. For example, during the winter months, cold air infiltration around doors and windows into the interior of a house causes an increase in the heating costs for the house. In extreme cases, such air infiltration may require that the house have a heating system with a capacity which is larger than would otherwise be necessary. The same is true for hot air infiltration during the summer. Such infiltration is a factor which increases the costs of cooling a house with conventional air conditioning equipment.

Weatherstrip materials refer generically to the class of materials which is used to seal the joints or spaces between doors and windows and their respective casings to stop infiltration of air, rain, snow and the like. Weatherstrip materials have a variety of configurations depending upon which particular type of product they are associated with. One particular type of product utilizing weatherstrip material is that which is known as the Andersen Perma-Shield® Gliding Doors. The Perma-Shield® Gliding Door unit is a door unit for use generally adjacent the patio of a house. This door unit includes a door frame and two door panels. The door panels contain a glazing which comprises a double-paned safety insulating glass. One of the door panels is fixed inside the frame. The other door panel slides relatively thereto to open and close the door opening in the door unit. However, when the door panels are in their closed positions (i.e., the door opening is closed), the innermost frame members or the meeting stiles of each door panel are located generally adjacent one another and are spaced apart by a small gap. It has been conventional to place a weatherstrip material into this gap for sealing the door unit against air infiltration and the like.

The weatherstrip material previously used with the Perma-Shield® Gliding Door unit comprises what might be called a rigid interlocking type of weatherstrip. This weatherstrip is made from a rigid plastic material, such as rigid PVC. The cross-sectional configuration of this weatherstrip material was such that when the door panels were closed the weatherstrip members had various flanges or the like which would releasably interlock. However, in the Perma-Shield® glass door unit, the glass panes and door panels are quite long, wide and heavy. A common problem with such door panels is that the panels can bow or curve along the length thereof. Although the panels are fixed at the top and bottom of the glass door unit in the tracks for the door panels, the bow in the panels can easily increase or decrease the nominal thickness or gap between the panels at the center thereof. This decrease or increase in the thickness can be up to 50% of the nominal gap valve. When the nominal thickness is varied this much, the use of a rigid, interlocking type of weatherstrip presents certain problems, namely the door panels cannot be easily slid together to their closed position. In certain instances, trying to close the door panels with the nominal thickness having been increased or decreased will cause the rigid interlocking type of weatherstripping material to fracture or break. Such a fracture or break of course requires that the weatherstrip be replaced. Such replacement is burdensome, time-consuming and expensive.

SUMMARY OF THE INVENTION

One aspect of this invention relates to an improved weatherstrip system and material for use with a gliding door unit. The weatherstrip material effectively prevents infiltration of weather elements, such as air, regardless of variation in the gap thickness between two opposed frame members of the door unit.

This invention comprises a weatherstrip material which is particularly suited for use with a gliding door unit of the type having a movable door panel and a fixed door panel. Each of the door panels is generally rectangular having four frame members which serve to support a transparent glazing. The innermost vertical frame members of the door panels are commonly known as meeting stiles. These stiles will be opposed to one another when the door unit panels are in a closed position and will be spaced apart by a gap. The weatherstrip material of this invention comprises first and second weatherstrip members fixed respectively to each of the meeting stiles. Each weatherstrip member comprises a relatively rigid base having two outwardly projecting flexible legs. One of the legs of the weatherstrip member abuts against a side of the opposed meeting stile. The other leg of the weatherstrip member resiliently and sealingly engages a corresponding leg on the opposed weatherstrip member. Thus, the weatherstrip members seal the gap regardless of the actual gap thickness between the meeting stiles because of the resilience of the aforementioned legs.

BRIEF DESCRIPTION OF THE DRAWINGS

The present invention will be described hereafter in the following Detailed Description, when taken in conjunction with the following drawings, in which like reference numerals represent like elements throughout the several views.

DETAILED DESCRIPTION

Figure 1:
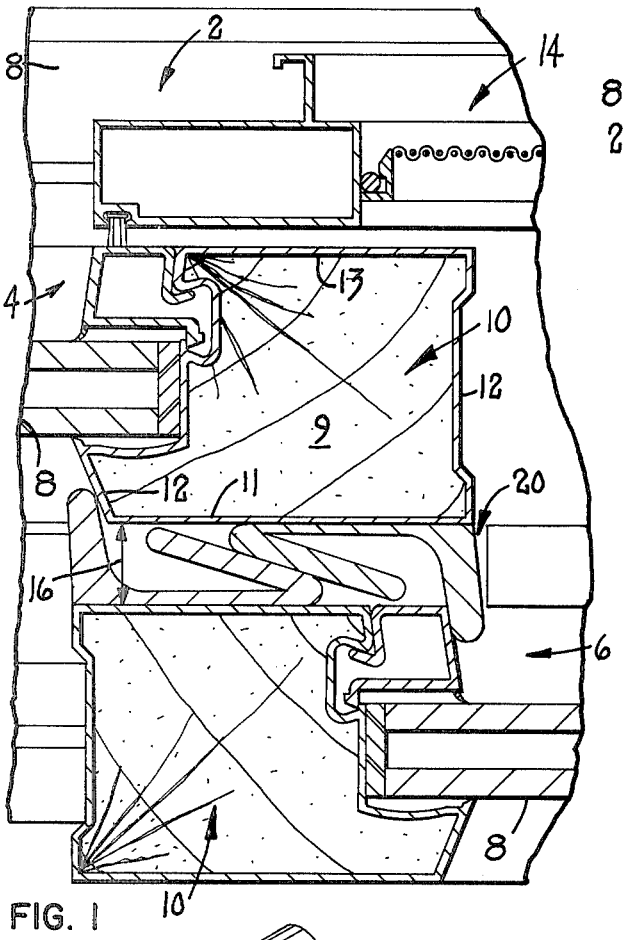
FIG. 1 is a cross-sectional view along a horizontal line through an improved sliding door unit according to this invention, particularly illustrating the improved weatherstrip materials of this invention emplaced in the gap between the opposed meeting stiles of the door panels.

The present invention relates to an improved weatherstrip system or weatherstrip material illustrated herein as 20. Weatherstrip material 20 is particularly designed for use with sliding glass door units or sliding door units in general. Such sliding glass door units customarily comprise a fixed door panel and a movable door panel. The door panels support relatively large planar glazing members or transparent glass panes. Although weatherstrip material 20 is preferred for use with sliding door units, its use is not limited to such units. For example, weatherstrip material 20 may also be used to seal the gap occurring between the check rails of a conventional double-hung sash window or the like. In general, the weatherstrip material 20 can be used to seal the gap between any two spaced and opposed longitudinally extending surfaces. More particularly, weatherstrip material 20 is designed to be used when the gap between such surfaces is likely to vary from a normal nominal value.

One particular type of sliding glass door unit with which weatherstrip material 20 is particuarly appropriate will be illustrated herein as door unit 2. Door unit 2 is preferably of the type which is known as the Perma-Shield ® Gliding Door II, manufactured by the Andersen Corporation of Bayport, Minnesota. Door unit 2 comprises a fixed door panel 4 and a movable door panel 6 supported in a door frame having a sill or threshold 8. Door panels 4 and 6 are substantially identical except for the fact that door panel 4 is fixed on sill 8 while door panel 6 is slidably movable thereon in an anodized aluminum track. Movement of door panel 6 can open and close a door opening 7 in door unit 2. In addition, door unit 2 can optionally comprise or include a screen door 14 which is slidable on sill 8. Screen door 14 is positioned to the exterior of fixed door panel 4. Screen door 14 is also normally located in front of the door opening 7 to keep bugs and the like from the interior of the building in which door unit 2 is mounted.

Door panels 4 and 6 usually comprise a rectangular frame in which a glazing member 8 is fixedly supported. As shown herein, glazing member 8 comprises double-paned safety insulating glass. The frame of the door panels 4 and 6 each comprise to vertically extending members customarily referred to as stiles. These stiles are connected at their top and bottom ends by horizontally extending rails (not shown). When door panels 4 and 6 are in a closed position such that the movable panel 6 allows no access through door opening 7, two of the vertically extending stiles on the door panels 4 and 6 will be aligned with one another in a generally parallel and spaced relationship. These stiles are illustrated generally as 10 in FIGS. 1 and 2 and are usually called the meeting stiles. The meeting stiles 10 have a generally rectangular cross-section. This cross-section includes a first longitudinally extending surface 11 and two side surfaces 12 which extend rearwardly from the surface 11. Although side surfaces 12 are generally normal to surface 11, they may extend at any angle relatively thereto. Stiles 10 then include a second surface 13 which is parallel to the surface 11 and which joins together the side surfaces 12 at their opposed ends. As disclosed herein, stiles 10 have a wooden core 9 therein.

When the door panels 4 and 6 are closed such that the meeting stiles 10 and 12 are opposed to one another, stiles 10 will be spaced from one another by a distance or gap which is generally indicated as 16. Gap 16 has a normal value which may be known as the nominal gap thickness. It is easy to maintain the thickness of gap 16 close to the nominal value at or adjacent the very top and bottom of door panels 4 and 6. This is so because door panels 4 and 6 are held at the top or bottom in a fixed relationship relative to one another by virtue of the supports or tracks in the door frame in which the panels are mounted. However, the glazing members 14 carried by the door panels 4 and 6 are very large. In the manufacture of such large glazing members, it is not uncommon for such panels to bow or become curved which bow is often imparted to door panels 4 and 6. Thus, it is apparent that between the top and bottom of the door panels 4 and 6, the actual gap thickness at various places can vary from the nominal value. This variance is often greatest at the midpoint of the panels 4 and 6 taken with reference to the top and bottom edges of the panels. For example, if the nominal gap thickness of the panels at the center thereof is desirably $\frac{1}{2}$ inch, the actual gap thickness is often $\pm\frac{1}{4}$ inch. In other words, the actual gap thickness at the center of door panels 4 and 6 may be as small as $\frac{1}{4}$ inch or as large as $\frac{3}{4}$ inch.

Weatherstrip material 20 comprises a unique system for ensuring that the gap 16 between the panels is adequately sealed regardless of the actual gap thickness. A first embodiment for weatherstrip material 20 comprises two full length resilient vinyl covered weatherstrip members 22. Weatherstrip members 22 are full length so that they run the entire length of the surfaces 11 of meeting stiles 10. In particular, the construction of the weatherstrip members 22 ensures and provides a flexible seal between the meeting stiles 10.

Figure 3:
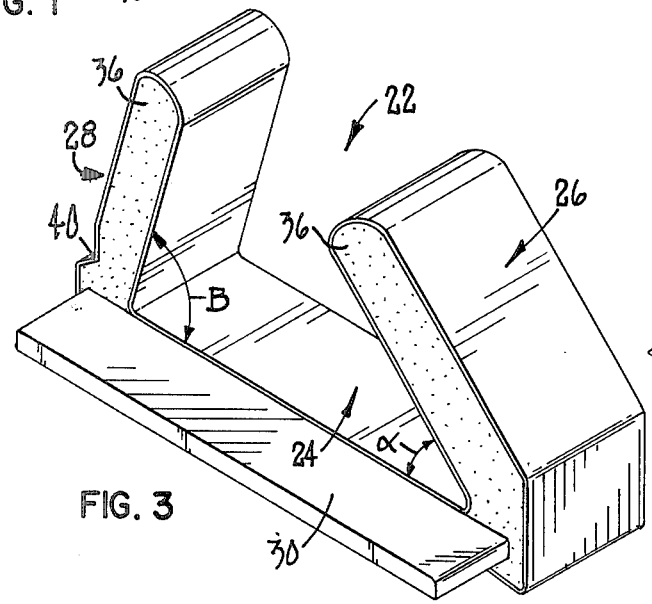
FIG. 3 is a perspective view of one embodiment of a weatherstrip member forming a portion of the weatherstrip materials according to this invention, showing the weatherstrip member partially broken away for clarity.

Referring now to FIG. 3, the construction of weatherstrip member 22 is illustrated particularly herein. Weatherstrip member 22 comprises a relatively planar and rigid base section 24. Base section 24 has two upwardly extending sealing surfaces or legs 26 and 28. When these legs are undeformed, the first leg 26 extends at an angle relative to base section 24 which angle is designated as $\alpha$. Similarly, the second leg 28 extends relatively to base section 24 at an angle which is referred to as $\beta$. The angles $\alpha$ and $\beta$ can vary within the range of 0°–90°. However, the angle $\alpha$ is preferably less than 90° so that first leg 26 is angled relatively to base section 24. The angle $\beta$ is also preferably less than 90°, but only slightly less, i.e. $\beta$ is preferably 70°–90°.

Base section 24 is comprised of a substantially rigid base member 30 which extends the entire length of weatherstrip member 22. Base member 30 comprises a substantially planar sheet of material. Base member 30 may be any rigid plastic, metallic, woven wire, or other suitable base material which provides rigidity to the weatherstrip member 22.

Figure 4:
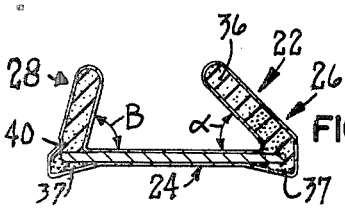
FIG. 4 is a cross-sectional view of the weatherstrip member shown in FIG. 3.

Legs 26 and 28 and base section 24 are also partially formed of a suitable resilient material 36. Preferably, material 36 comprises a urethane type foam or any other suitable foam. Foam material 36 is actually formed into the configuration of legs 26 and 28 and also covers the top of base member 30. In addition, as shown in FIGS. 3 and 4, the foam material 36 is also formed to define two downwardly projecting feet or pads 37. Pads 37 are positioned beneath each end of base member 30. Finally, the entire foam material 36 and base member is covered by an outer cover 38. Preferably, cover 38 comprises a vinyl film which helps form the cross-sectional profile of the weatherstrip member 22 and protects foam material 36. Legs 28 have the outer vinyl cover 38 crimped or indented as at 40 along the entire length thereof. This crimp line 40 forms a pivot point or hinge line for the legs 28 for a purpose to be described hereafter.

Figure 2:
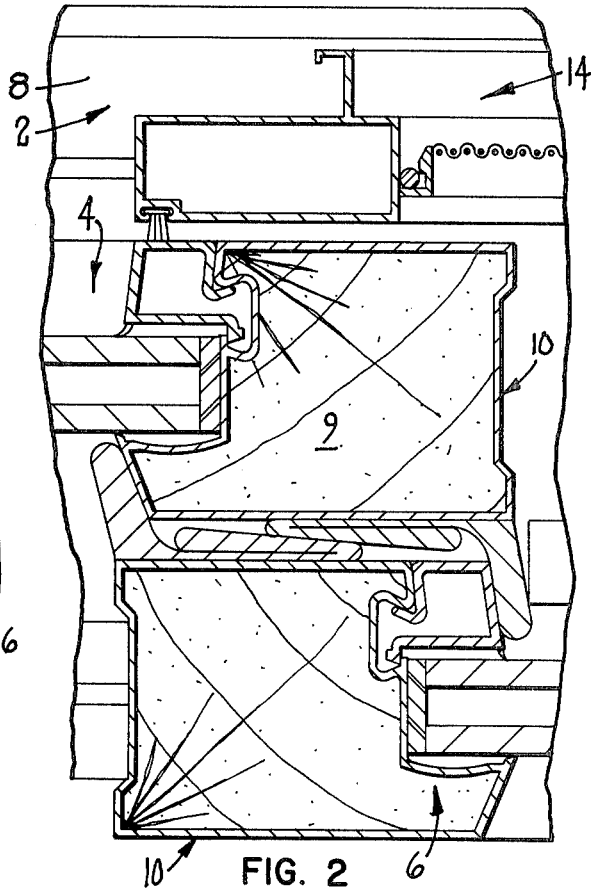
FIG. 2 is a view similar to FIG. 1, showing the weatherstrip materials emplaced in the gap of the door unit when the gap thickness has been decreased from a nominal value.

Referring now to FIGS. 1 and 2, the operation of the weatherstrip members 22 will be described. Each weatherstrip member 22 is fixedly secured to surface 11 of one of the meeting stiles 10. This securing is achieved by fixedly securing the base section 24 to the surface as by gluing or by using a mechanical attachment such as a screw or staple. Each weatherstrip member 22 is positioned on surface 11 such that the second leg 28 thereof is located generally adjacent one end of meeting stile 10. Both the first leg 26 and the second leg 28 of each weatherstrip member 22 extend outwardly into the gap 16. However, as shown in FIG. 1, weatherstrip member 22 are so positioned such that the outer end of the second leg 28 of each weatherstrip member 22 abuts against one side surface 12 of the opposed meeting stile 10. The pads 37 on base section 30 further enhance the sealing of the weatherstrip member 22 to the surface 11 of meeting stile 10.

Referring now to FIG. 1, it can be seen that when the weatherstrip members 22 are positioned as noted above and the door panels 4 and 6 are closed such that the meeting stiles 10 are adjacent one another, the first legs 26 will engage each other in a mating face-to-face relationship. In addition, the second legs 28 abut against the side surfaces 12 of the meeting stiles to further enhance the sealing of the meeting stiles 10. Any air or other infiltrating substance which would penetrate between the meeting stiles 10 would first have to get past one of the second legs 28, past the engaged first legs 26, and past the other second leg 28. Hinge line 40 assists the second leg 28 in flexing or pivoting so that it can conform to whatever angular orientation is presented by the side surface 12 of the meeting stile 10.

The FIG. 1 orientation shows the orientation of the weatherstrip members 22 when the thickness of gap 16 is at the nominal value thereof. Referring now to FIG. 2, when the actual gap thickness has been decreased from its nominal value (e.g. from a $\frac{1}{2}$ inch to a $\frac{1}{4}$ inch), the flexible first legs 26 will flex or pivot to accommodate this change in the actual gap thickness. Even though legs 26 flex to accommodate a variation in the gap thickness, they still maintain their face-to-face sealing engagement. The second legs 28 also can flex or pivot to still maintain their engagement with the side surfaces 12. Although FIG. 2 illustrates the configuration of weatherstrip members 22 when the actual gap thickness decreases from its nominal value, weatherstrip members 22 will also be effective to maintain a seal if the actual gap thickness is increased from its nominal value. The actual gap thickness may vary all along the surfaces 11 from the top to the bottom of door panels 4 and 6. For instance, at one point the actual gap thickness may have increased from the nominal value while at another point the actual gap thickness may have decreased. Nonetheless, weatherstrip members 22 will effectively seal the entire length of surfaces 11 regardless of the variations in the actual gap thickness. Thus, the weatherstrip material 20 according to this invention is particularly advantageous.

Figure 5:
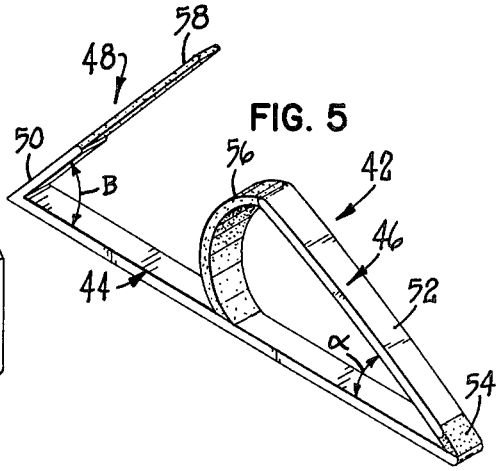
FIG. 5 is a perspective view of a second embodiment of a weatherstrip member forming a portion of the weatherstrip materials according to this invention.
Figure 6:
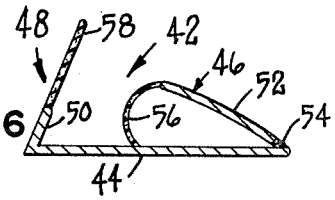
FIG. 6 is a cross-sectional view of the weatherstrip member shown in FIG. 5.

Referring now to FIGS. 5 and 6, a second embodiment for weatherstrip material 20 according to this invention is disclosed as weathersrip member 42. Two weatherstrip members 42 will be used generally in the same manner and orientation as the weatherstrip members 22. Such weatherstrip members 42 also have a structure which is generally similar to weatherstrip members 22. In other words, each weatherstrip member 42 comprises a substantially rigid base section 44, a flexible first leg 46, and a flexible second leg 48.

Rigid base section 44 comprises a thin piece of relatively rigid material. A rigid flange 50 protrudes upwardly from one end of base 44 at an angle thereof and constitutes a rigid leg portion of second leg 48. The first leg 46 of the weatherstrip member 42 is formed partially from a substantially rigid leg portion 52. Leg portion 52 is resiliently and flexibly attached to the base 44 by suitable hinge means. These hinge means include a first resilient hinge 54 connecting one end of the rigid leg portion 52 to the end of base 44, and a second resilient hinge 56 which is arcuately shaped and which connects the other end of leg portion 52 to approximately the midpoint of base 44. The second flexible leg 48 comprises an outwardly extending planar piece 58 of flexible material which is integrally secured to the upwardly extending leg portion 50. Both the first and second legs 46 and 48 define the same angles $\alpha$ and $\beta$ with regard to base section 44 as were defined by weatherstrip member 22.

Weatherstrip member 42 functions identically to weatherstrip member 22. In other words, first and second legs 46 and 48 can flex and pivot to resiliently insure a seal between the opposed meeting stiles 10 regardless of the variation in the actual gap distance thereof. The materials which comprise weatherstrip member 42 may be any suitable materials. For example, the rigid sections of weatherstrip member 42, i.e. base 44 and the rigid leg portions 50 and 52, preferably comprise relatively rigid PVC plastic material. The flexible portions of weatherstrip member 42, i.e. the hinges 54 and 56 and the flexible leg portion 58, preferably comprise any suitably resilient material, such as resilient PVC.

Thus, the weatherstrip members 22 and 42 disclosed by this invention are particularly advantageous. They allow the gap 16 occurring between two closed meeting stiles 10, or between any two opposed longitudinally extending surfaces, to be sealed regardless of the actual gap distance therein. This obviates the disadvantage of the prior art rigid type weatherstripping in which a variation in the gap thickness often caused the weatherstripping to fracture. Weatherstrip materials 20 can be sold in a single elongated piece with the weatherstrip members 22 being cut to length by the user thereof. Alternatively, weatherstrip members 22 can also be sold in a kit form in which the weatherstrip members have been pre-cut to length at the factory or other place of manufacture. Furthermore, weatherstrip members 22 may be sold as part of an improved door unit 2.

Various modifications of this invention will be apparent to those skilled in the art. For example, although it is preferred that second legs 28 and 48 be provided on each of the weatherstrip members, these weatherstrip members could still function effectively as a sealing agent with just the first legs 26 and 46 being present. Thus, the scope of this invention is to be limited only by the appended claims.

What is claimed is:

1. An improved sliding door unit having a frame; first and second door panels, at least one of the door panels being slidable in the frame relative to the other door panel to open and close a door opening; wherein each door panel includes a vertically extending meeting stile, wherein each meeting stile includes a longitudinal surface and two side edges which extend rearwardly from the longitudinal surface to define opposed sides of the meeting stile, the meeting stiles being located adjacent and opposed to one another with the longitudinal surfaces thereof being disposed in a face-to-face relationship and spaced from one another by a gap when the first and second door panels are disposed in a closed orientation; and wherein the improvement relates to:

a weatherstrip material which is insertable into the gap between the meeting stiles, the weatherstrip material having a flexible configuration to allow the gap to be sealed regardless of any variation in the thickness of the gap from a nominal value, wherein the weatherstrip material comprises first and second longitudinally elongated weatherstrip members, each weatherstrip member having a substantially rigid base and a first flexible leg projecting outwardly therefrom, each weatherstrip member having the base thereof fixedly secured to the longitudinal surface of one of the meeting stiles with the first flexible leg extending outwardly into the gap, and wherein the first flexible legs of the first and second weatherstrip members are oriented on the bases to engage one another to seal the gap between the meeting stiles, wherein the rigid base further includes a second outwardly projecting flexible leg thereon, said second leg extending substantially outwardly from the base in the same direction as the first leg and into the gap, wherein the second flexible leg is pivotably movable relative to the base to vary the angle that the second leg forms relative to the base, and wherein the second flexible leg extends outwardly sufficiently far from the rigid base and is located thereon such that the second leg of each weatherstrip member engages one of the side edges of the meeting stile on which the other weatherstrip member is secured, whereby the second legs of the weatherstrip members mask off the gap to minimize weather infiltration through the gap.

2. An improved sliding door unit as recited in claim 1, in which the rigid base of each weatherstrip member comprises a substantially rigid plate, each plate having the first flexible leg positioend adjacent one end thereof, and wherein the first flexible leg comprises a foamed material.

3. An improved sliding door unit as recited in claim 1, wherein the first flexible leg of each weatherstrip member extends an an angle relatively to the rigid base.

4. An improved sliding door unit as recited in claim 1, in which the second flexible leg has a hinge line integrally formed therein to facilitate rotary movement of the second leg.

5. An improved sliding door unit as recited in claim 1, in which the first and second flexible legs are each made of a foamed material suitably bonded adjacent either end of the rigid base, and wherein the base and foamed legs are surrounded by an outer covering to complete the weatherstrip member.

6. An improved sliding door unit as recited in claim 1, in which pad portions are formed on the side of the rigid base secured to the meeting stile to enhance the sealing of the base therewith.

7. An improved sliding door unit as recited in claim 9, in which the pads are formed of a resilient material.

8. An improved sliding door unit as recited in claim 1, in which the first flexible leg includes a relatively rigid leg portion which is resiliently secured to the rigid base by at least one flexible hinge portion.

9. An improved sliding door unit as recited in claim 11, in which the rigid base and the rigid leg portion are made of relatively rigid plastic material and the hinge portion is formed of a substantially resilient plastic material.

10. An improved sliding door unit as recited in claim 8, in which each weatherstrip member further include a second flexible leg secured to the rigid base, wherein the second flexible leg comprises a substantially rigid leg portion secured to the base and having an outer flexible leg portion secured thereto, and wherein the outer flexible leg portion is made sufficiently long such that the second leg extends substantially outwardly from the rigid base.

* * * * *

UNITED STATES PATENT AND TRADEMARK OFFICE

CERTIFICATE OF CORRECTION

PATENT NO. : 4,185,416

DATED : January 29, 1980

INVENTOR(S) : Richard J. Wilmes

It is certified that error appears in the above-identified patent and that said Letters Patent are hereby corrected as shown below:

In column 3, line 51, for "to" read --two--.

In column 5, line 21, for "member" read --members--.

In column 8, line 6, for "positioend" read --positioned--.

line 11, for "extends an an" read --extends at an--.

Signed and Sealed this

*Sixth* Day of *May 1980*

[SEAL]

*Attest:*

SIDNEY A. DIAMOND

*Attesting Officer*

*Commissioner of Patents and Trademarks*